United States Patent [19]

O'Connor

[11] Patent Number: 4,635,566

[45] Date of Patent: Jan. 13, 1987

[54] FUEL MIXER AND BURNER

[76] Inventor: Chadwell O'Connor, 2024 Galaxy Dr., Newport Beach, Calif. 92660

[21] Appl. No.: 367,039

[22] Filed: Apr. 9, 1982

[51] Int. Cl.[4] ..... F23K 1/00; B02C 15/06

[52] U.S. Cl. ..... 110/106; 241/278 R; 241/57; 110/101 R; 110/222

[58] Field of Search ..... 110/101 R, 101 CF, 104 R, 110/105, 106, 222, 232, 267; 241/278 R, 57

[56] References Cited

U.S. PATENT DOCUMENTS

| | | | |
|---|---|---|---|
| 2,213,668 | 9/1940 | Dundas et al. | 110/222 |
| 2,417,564 | 3/1947 | Newman | 241/278 R |
| 3,002,472 | 10/1961 | Miller | 110/106 |
| 3,227,530 | 1/1966 | Levelton | 44/1 R |
| 4,002,298 | 1/1977 | Latora | 241/278 R |
| 4,041,906 | 8/1977 | Edwards | 110/222 |
| 4,151,962 | 5/1979 | Calhoun et al. | 241/278 R |
| 4,264,041 | 4/1981 | Kitto, Jr. et al. | 241/57 |

FOREIGN PATENT DOCUMENTS

| | | | |
|---|---|---|---|
| 2015894 | 9/1979 | United Kingdom | 241/278 R |

*Primary Examiner*—Henry C. Yuen

*Attorney, Agent, or Firm*—Leydig, Voit & Mayer

[57] ABSTRACT

A fuel mixer and burner in which a disk with an open face is rapidly rotated within a loosely confining chamber rectangular in cross section and having aligned inlet and outlet openings. A blower delivers air at high volumes and velocities to the inlet opening of the chamber so that air flows parallel to the disk face, and fuel is directed perpendicularly against the disk face. For liquid fuels including heavy oils, the fuel is directed through a nozzle against a smooth disk face. For solid fuels, pieces of fuel are fed by an auger conveyor against a rough grinding surface on the disk. The fuel is particlized, thrown peripherally in all directions from the disk, intermixed thoroughly with air, and blown toward and through the chamber outlet opening. When ignited, the fuel-air mixture creates a flame formed about the disk that is directed out the outlet opening.

5 Claims, 4 Drawing Figures

FUEL MIXER AND BURNER

This invention relates generally to devices for mixing fuel with air for immediate, or later, burning and more particularly concerns devices for so handling solid and low grade liquid fuels.

Solid fuel such as coal is often pulverized before being fed for burning into large boilers, and this has also been suggested for smaller boilers like those used in steam locomotives; see Hogg U.S. Pat. No. 2,126,776. Liquid fuel, or already pulverized solid fuel, has been mixed with air for burning by being impacted on a rapidly rotating disk, as shown by Gibbs U.S. Pat. No. 762,048—Loepsinger U.S. Pat. No. 2,182,897—Tsuji U.S. Pat. No. 3,697,214 and Bakus U.S. Pat. No. 4,125,358. It has also been suggested that rotating disks can be used as grinders to shred material such as garbage for incineration; see Stevens U.S. Pat. No. 3,357,377 and Oseroff U.S. Pat. No. 3,550,541.

It is the primary aim of the invention to improve the results achieved with devices of the foregoing kind through a basic change in the geometry and philosophy of such units.

An object of the invention is to provide such an improved mixer and burner that is versatile as to usable fuel, being adapted to handle difficult-to-burn liquid fuels such as crude or residual oils, or Bunker C fuel and, with minor modifications, also solid fuel like coal.

Another object of the invention is to provide a mixer and burner of the foregoing type which is very fuel efficient and capable of creating a very tight, hot flame consuming the fuel in use. A further object is to provide such a mixer and burner adapted for pushbutton control even with hard-to-burn fuel; such control including on-off, pilot ignition and modulation.

Yet another object is to provide a mixer and burner as characterized above that is quite compact, and indeed can be miniaturized for applications normally calling for small nozzles, but which is also basically simple in design so as to be economical to manufacture and maintain.

Other objects and advantages of the invention will become apparent upon reading the following detailed description and upon reference to the drawings, in which.

Figure 1:
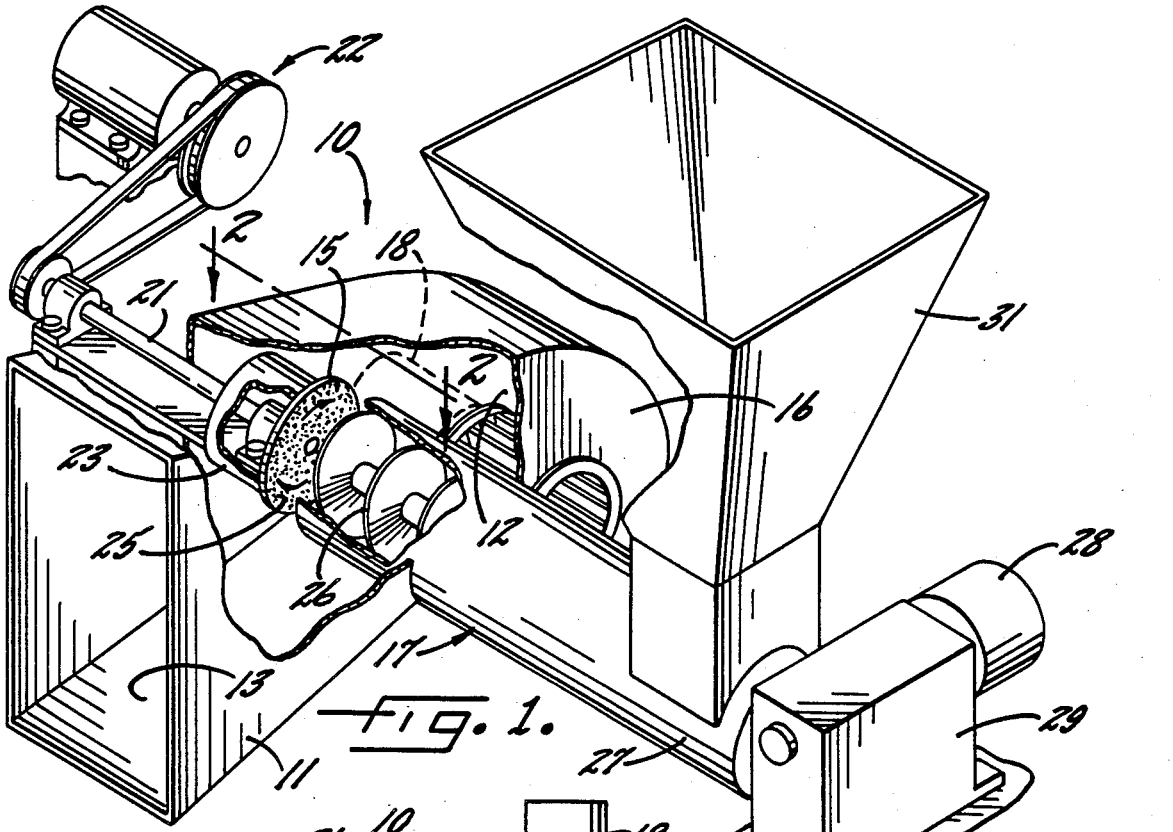
FIG. 1 is a somewhat schematic perspective with portions broken away of an assembly embodying the present invention.
Figure 2:
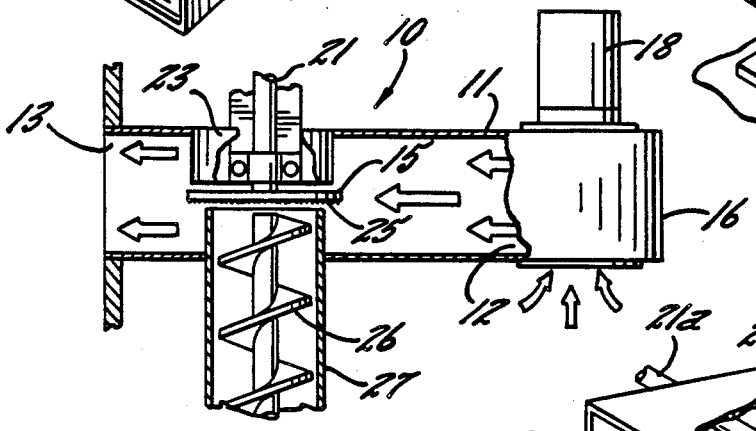
FIG. 2 is a fragmentary section, somewhat enlarged, taken approximately along the line 2—2 of FIG. 1.
Figure 3:
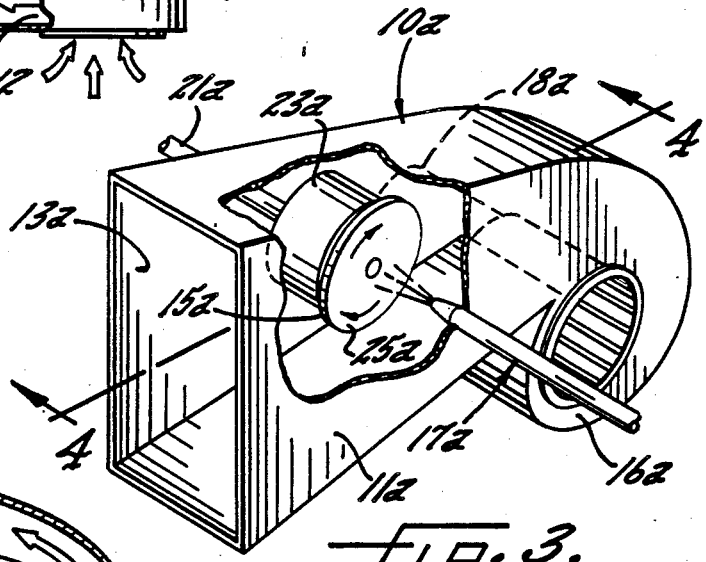
FIG. 3 is a fragmentary perspective similar to that of FIG. 1 but showing an alternate construction.

While the invention will be described in connection with preferred embodiments, it will be understood that I do not intend to limit the invention to those embodiments. On the contrary, I intend to cover all alternatives, modifications and equivalents as may be included within the spirit and scope of the invention as defined by the appended claims.

Turning to the drawing, there is shown an assembly 10 for handling solid fuel like coal and an assembly **10*a* for handling liquid fuel like Bunker C oil, each of which embodies the invention. Parts that correspond in the two assemblies 10, 10*a*** have been given the same reference numeral with the distinguishing suffix a added.

The assemblies **10, 10*a* include chambers 11, 11*a* having aligned inlet openings 12, 12*a* and outlet openings 13, 13*a*, driven disks 15, 15*a* mounted for rapid rotation in the chambers, blowers 16, 16*a* for delivering air at high speeds and volumes to the inlet chamber openings 12, 12*a*, and devices 17, 17*a* for directing combustible fuel against the disks 15, 15*a*. Preferably, the blowers 16, 16*a* are of the wheel or squirrel cage type driven by electric motors 18, 18*a*, and the blower housings are formed as integral parts of the chambers 11, 11*a*. The disks 15, 15*a* are mounted on journaled shafts 21, 21*a* which can be driven at high speeds, as by a motor and pulley assembly 22. The journaled ends of the shafts 21, 21*a* next to the disks 15, 15*a* are protected by cylindrical shields 23, 23*a*.**

In accordance with the invention, the disks **15, 15*a* have flat annular faces 25, 25*a* mounted in a plane that substantially bisects the inlet and outlet openings 12, 12*a* and 13, 13*a*, and fuel is directed perpendicularly against the disk faces. Preferably, the cross sections of the chambers 11, 11*a* are rectangular with the long dimension paralleling the disk faces 25, 25*a*. The chambers thus loosely confine the respective disks. In the case of the solid fuel assembly 10, the device 17 is an auger conveyor including an auger 26 in a conveyor tube 27 driven by a motor 28 through a gear box 29 and receiving pieces of coal from a hopper 31. The disk face 25 is roughened to define a grinding surface, as by implanting diamond chips on the disk, so that pieces of coal forced by the auger 26 against the disk face 25 are ground into particles at the face. The feed rate of the auger 26 is less than the potential grinding rate of the disk 15**.

In the case of the liquid fuel assembly **10*a*, the device 17*a* is a simple nozzle and pipe sized to convey heavy viscous fuels such as Bunker C, residual and crude oils. The disk face 25*a*** is flat and smooth.

Figure 4:
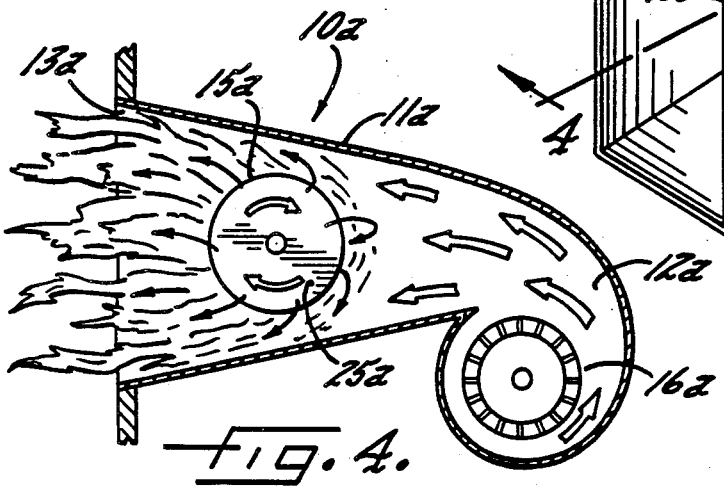
FIG. 4 is a fragmentary section taken approximately along the line 4—4 in FIG. 3.

In each case, fuel is particlized, thrown peripherally in all directions from the disk, thoroughly intermixed with air flowing from the blower, and blown toward and through the outlet opening. As suggested by FIG. 4, only a small fraction of the fuel particles are thrown initially by the disk face **25*a* toward the outlet opening 13*a*. Many particles are thrown crossways to the air flow, and some are thrown the "wrong" way toward the inlet opening 12*a*. However, the air stream from the blower 16*a* eventually modifies the particle paths so that all are curved toward the outlet opening 13*a*.** Those particles initially bucking, or partially bucking, the air stream become particularly well mixed with the air.

Igniting the fuel-air mixture causes a flame to be formed around the disks **15, 15*a* that is directed toward the outlet openings 13, 13*a*. The burning of the particularly well mixed particles initially thrown toward the inlet openings 12, 12*a* heats the region downstream so that fuel particles in that region can vaporize and burn more readily. The disks 15, 15*a*** can be also expected to get quite hot, so that vaporization is helped by initial fuel contact with the disks. As a result, a very tight, hot flame is developed that effectively consumes the fuel.

While the assemblies **10, 10*a* illustrated show disks 15, 15*a*** approximating 3" in diameter, it is contemplated that the same mixing principle can be utilized on a very small scale, as in an internal combustion engine carburetor where burning would occur at a point downstream of the disk itself. For a 3" diameter wheel, a rotational speed of about 10,000 rpm is contemplated. Depending on the size of the disk and the nature of the fuel being used, it could be desirable to water cool the disks by introducing water through hollow drive shafts to hollow disks.

Two broad physical characteristics are believed to distinguish the assemblies 10, 10*a* from conventional fuel mixers and burners. First, fuel and air are normally directed in the same direction with perhaps counterrotation being provided in order to facilitate fuel-air mixing. In this case, the majority of the fuel particles are not initially directed in the path of the air stream. Second, conventional designs are normally symmetrical about the center line of the flame envelope. Here, the initial burning chamber is rectangular and fuel is introduced at 90 degrees from one side of that chamber.

The great versatility of the assemblies 10, 10*a* in using a wide variety of fuel can readily be appreciated. Fuels that are normally hard to burn are effectively utilized because of the mechanical particlizing of the fuel. As already stated, a very tight hot flame is generated for complete and efficient fuel use.

It can also be appreciated that the assemblies 10, 10*a* are well suited for pushbutton control. In the case of the assembly 10, the operator need only start the blower motor 18, start the motor and pulley assembly 22 for the disk 15, and then initiate operation of the auger conveyor by starting the motor 28. This would shortly produce a combustible fuel-air mixture that could be ignited through a pilot light system. Modulation of the intensity of the flame would be controllable through blower and fuel feeding speeds.

It can also be seen that the assemblies 10, 10*a* can be designed to be quite compact since the design is basically quite simple. This simplicity of design also means that the assemblies are economical to manufacture and to maintain in good operating condition.

I claim as my invention:

1. A device for mixing fuel for burning comprising, in combination, a chamber having aligned inlet and outlet openings, a disk rotatably mounted in said chamber with a flat circular face in a plane that substantially bisects said openings, means for rapidly rotating said disk, a blower for delivering air at high speeds and volumes to said inlet opening, and means for directing, combustible fuel perpendicularly against said disk face so that the fuel is particlized, thrown in said plane peripherally in all directions from the disk, intermixed with air from said blower, and blown toward and through said outlet opening, whereby igniting the fuel-air mixture causes a flame to be formed around the disk that is directed out the outlet opening.

2. The combination of claim 1 in which said chamber is rectangular in cross section with the long dimension paralleling the face of said disk.

3. The combination of claim 1 in which said disk face is smooth, and said means for directing fuel includes a nozzle capable of discharging heavy viscous liquid fuel

4. The combination of claim 1 in which said disk face is roughened to define a grinding surface, and said means for directing fuel includes a mechanism for feeding pieces of solid fuel against said grinding surface, the feed rate of said mechanism being less than the potential grinding rate of said disk surface.

5. The combination of claim 4 in which said mechanism is an auger conveyor.

* * * * *